US006443694B1

(12) United States Patent
Karlsson

(10) Patent No.: US 6,443,694 B1
(45) Date of Patent: Sep. 3, 2002

(54) ROTOR MACHINE DEVICE

(75) Inventor: Urban Karlsson, Finspång (SE)

(73) Assignee: ABB, Vasteras (SE)

( * ) Notice: Subject to any disclaimer, the term of this patent is extended or adjusted under 35 U.S.C. 154(b) by 0 days.

(21) Appl. No.: 09/701,145

(22) PCT Filed: May 21, 1999

(86) PCT No.: PCT/SE99/00873

§ 371 (c)(1),
(2), (4) Date: Nov. 27, 2000

(87) PCT Pub. No.: WO99/61768

PCT Pub. Date: Dec. 2, 1999

(30) Foreign Application Priority Data

May 28, 1998 (SE) ..... 9801900

(51) Int. Cl.[7] ..... F03B 3/18
(52) U.S. Cl. ..... 415/115; 415/160
(58) Field of Search ..... 415/115, 160, 415/175, 178, 191

(56) References Cited

U.S. PATENT DOCUMENTS 2,836,393 A * 5/1958 Payne et al. ..... 415/115
3,652,177 A * 3/1972 Loebel ..... 415/110
4,173,120 A * 11/1979 Grosjean et al. ..... 415/115
4,193,738 A 3/1980 Landis, Jr. et al.
4,314,791 A 2/1982 Weiler
4,522,557 A 6/1985 Bouiller et al.
5,224,818 A 7/1993 Drerup et al.
5,795,128 A * 8/1998 Eichstadt ..... 415/115
5,993,150 A * 11/1999 Liotta et al. ..... 415/115

FOREIGN PATENT DOCUMENTS

JP 2001082170 A * 3/2001 ..... F02C/7/18

* cited by examiner

*Primary Examiner*—F. Daniel Lopez
*Assistant Examiner*—Richard A. Edgar
(74) *Attorney, Agent, or Firm*—Burns, Doane, Swecker & Mathis, L.L.P.

(57) ABSTRACT

A rotor machine arrangement comprises a rotor, a stator, at least one guide vane, which at two opposite ends is supported by the stator, and at least one end is pivotably arranged relative to the stator in at least a first plane, and at least one conducting member arranged to conduce a fluid into the guide vane for influencing the temperature of the same. The rotor machine arrangement comprises a sealing element which is pivotably connected with the guide vane in at least a second plane, is arranged to seal between the stator and the guide vane, and the sealing function of which is essentially independent of the angular position between the guide vane and the stator in said first plane.

11 Claims, 3 Drawing Sheets

ROTOR MACHINE DEVICE

BACKGROUND OF THE INVENTION AND PRIOR ART

Figure 1:
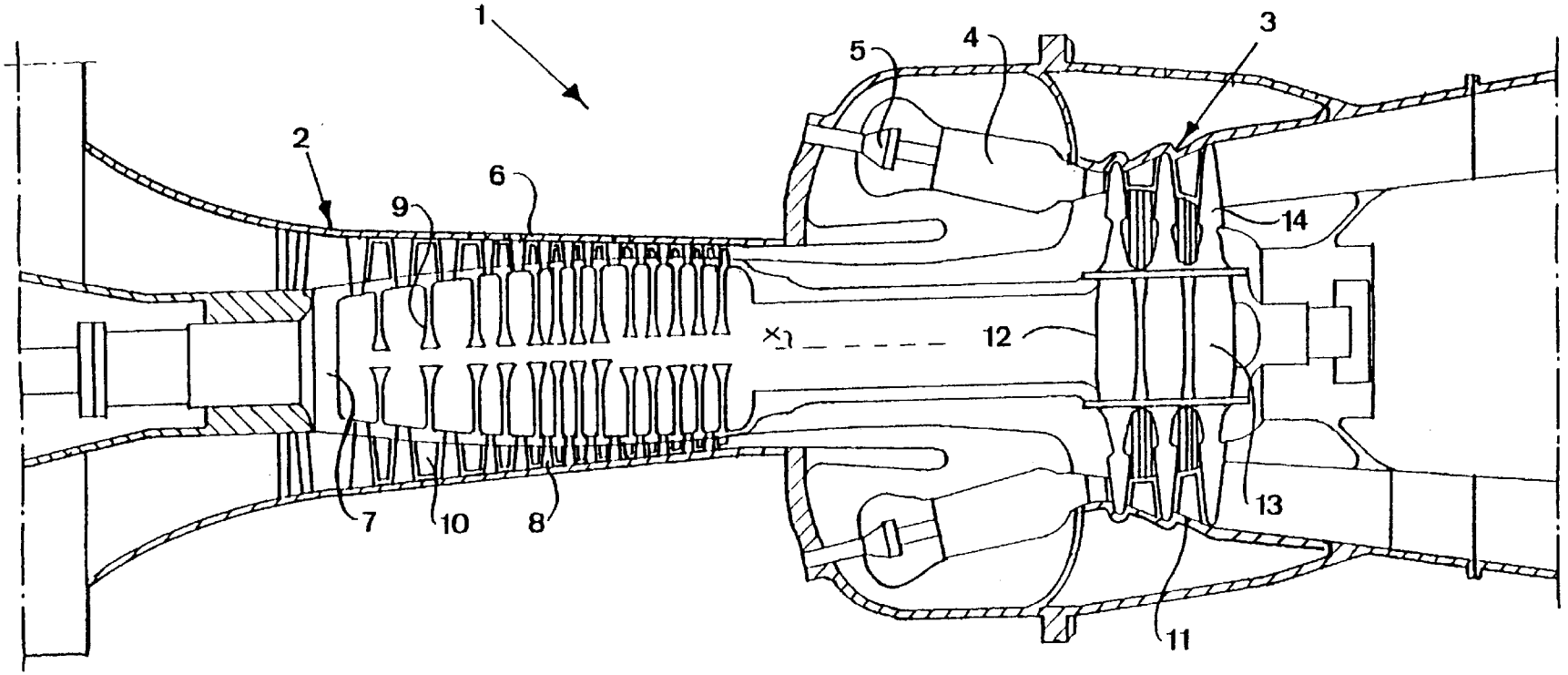

The present invention concerns a rotor machine arrangement, comprising a rotor, a stator, at least one guide vane, which at two opposite ends is supported by the stator, and at at least one end is pivotally arranged relative to the stator in at least a first plane, and at least one conducting member, arranged to conduct a fluid into the guide vane for influencing the temperature of the same.

Such arrangements are previously known in gas turbine arrangements, in which said fluid may be compressor air which has been drained off from a compressor included in the gas turbine arrangement, wherein the rotor machine arrangement in which said guide vane is provided is a turbine. The compressor air is used for cooling the guide vane from its interior. Small holes are arranged in the blade itself of the guide vane such that the compressor air is allowed to flow out from the same and into the gas flow channel of the turbine. Thanks to the cooling of the guide vane, too large temperature induced dimensional changes and heat influence on the material which shortens its life time may be reduced.

Usually the compressor air/cooling air is conducted through tubes and/or drilled holes in stationary stator parts to inlet chambers arranged at the two opposite ends of the guide vane. When the guide vane at both its ends is supported by the stator, or, more precisely, by guide vane carriers secured to the stator, the guide vane must be able to be tilted relative to surrounding stator parts because of the different axial movements which exist between the inner stator part which supports the one end of the guide vane and the outer stator part which supports its other end. By axial movements is meant movements in the axial direction of the rotor. Due to the fact that the pressure drop across the guide vane is large it is thereby difficult to avoid unwanted leakage of cooling air and gas around such tiltable, pivotable guide vanes. Leakage of compressor air which may not be used as cooling air into the gas flow channel of the turbine and leakage of gas out from the gas flow channel of course reduce the efficiency of the gas turbine arrangement.

SUMMARY OF THE INVENTION

The purpose of the present invention is to achieve a rotor machine arrangement of the initially defined kind which is arranged to prevent a fluid which is conducted into a guide vane for influencing the temperature of the same from leaking out between the stator and the guide vane even at different adjusted angles/pivotable positions between these in said first plane. Alternatively, a limited but controlled such leakage may be permitted, which leakage is essentially independent of said adjusted angles.

This purpose is achieved by means of a rotor machine arrangement as initially defined, which is characterised in that it comprises a sealing element which is pivotably connected with the guide vane in at least a second plane, is arranged to seal between the stator (11) and the guide vane (15), and the sealing function of which is essentially independent of the angular position between the guide vane (15) and the stator (11) in said first plane. The first and second planes are thereby preferably any of the planes in which the rotor axis of the rotor machine arrangement extends, here preferably parallel, and define preferably one and the same plane.

According to a preferred embodiment, the sealing element comprises a first sealing member arranged to seal between the guide vane and the sealing element, wherein the sealing function of said sealing member is essentially independent of the angular position between the guide vane and the sealing element in said second plane. Since the sealing element seals in this manner against the guide vane, a necessary condition for avoiding leakage of the fluid is given.

According to a further preferred embodiment, the sealing element is pivotably arranged relative to the stator in said second plane. The position of the sealing element may thereby be adjusted to a pivoting of the guide vane in the second plane in such a manner that the conditions for the function of the first sealing member will be good even at relatively large tilts of the guide vane relative to the stator.

According to a further preferred embodiment, the arrangement comprises a second sealing member, arranged to the seal between the sealing element and the stator, wherein the sealing function of said sealing member is essentially independent of the angular position between the sealing element and the stator in said second plane. The probability for a gas leakage or an air leakage via possible gaps between the surrounding stator parts and the movable component which the sealing element defines is thereby reduced.

According to a further preferred embodiment, the first sealing member comprises a bulge which extends around the outer circumference of the sealing element. The sealing element may thereby easily be constructed as a tube piece, arranged to be pushed into a recess of the guide vane, wherein the bulge, which preferably has a gently rounded outer periphery, may easily be formed in such a way that it allows a certain relative pivoting/tilting between the guide vane and the sealing element at the same time as it still sealingly abuts these. The bulge is preferably secured to and forms a part of the sealing element itself.

According to a further preferred embodiment, the second sealing member comprises a bulge, which extends around its outer circumference of the sealing element. It is preferably secured to and forms a part of the sealing element. It is thereby made possible to position the sealing element in a recess of the stator, preferably carrying members of the stator which are arranged to support the guide vane. The sealing element preferably has, in the area of said bulge, the shape of an essentially circular tube on the outside of which the bulge is provided. Such a design generates good conditions for both good sealing and relative movability between the sealing element and a recess in the stator, in which recess the sealing element is provided.

According to a further preferred embodiment, the sealing element comprises a cylinder body with an annular cross-section and with two annular bulges, each of which extends around the outer circumference of the sealing element and defines the first and the second sealing member, respectively. A sealing element with such a construction may easily be brought to abut guide vane carriers and recesses at end spaces of the guide vane. For example, a cooling medium/compressor air may via a chamber be conducted into the sealing element and via this element into the guide vane without any essential amount of the medium leaking out between the sealing element and the guide vane carrier into the flow channel of the rotor machine and without a gas to any larger extent leaks the opposite way. Furthermore, the cooling medium which has been conducted into the sealing element will be prevented from leaking out via some gap between the sealing element and a recess of the guide vane in which the sealing element is introduced.

According to a further preferred embodiment, the guide vane is pivotably arranged relative to the stator at both ends, a further conducting member is arranged to conduct the fluid influencing the temperature to the second end of the guide vane, and one sealing element with said first and/or second sealing member is arranged at each of the ends of the guide vane. A very good supply to the guide vane of for example cooling air from a compressor included in the rotor machine arrangement or connected thereto is thereby achieved at the same time as a possible leakage of cooling air outside of the sealing elements and into the gas flow channel of the turbine is kept at a reduced level.

According to a further preferred embodiment, the rotor machine arrangement comprises a plurality of guide vanes, arranged in a ring and each of which is connected with said conducting member, wherein first and/or second sealing members are arranged at each of the guide vanes. Such an arrangement is in particular advantageous when the rotor machine arrangement comprises a turbine, where said ring of guide vanes is the first of a plurality of rings as seen in the flow direction of the turbine and said ring is arranged in the area of an inlet to the turbine, where the gas flowing in is very hot, has a high pressure and where the individual guide vanes at two opposite ends are attached to a radially outer and a radially inner stator part.

Further features of and advantage with the rotor machine arrangement according to the invention will be clear from the following description and from the appendant claims.

SHORT DESCRIPTION OF THE DRAWINGS

Figure 2:
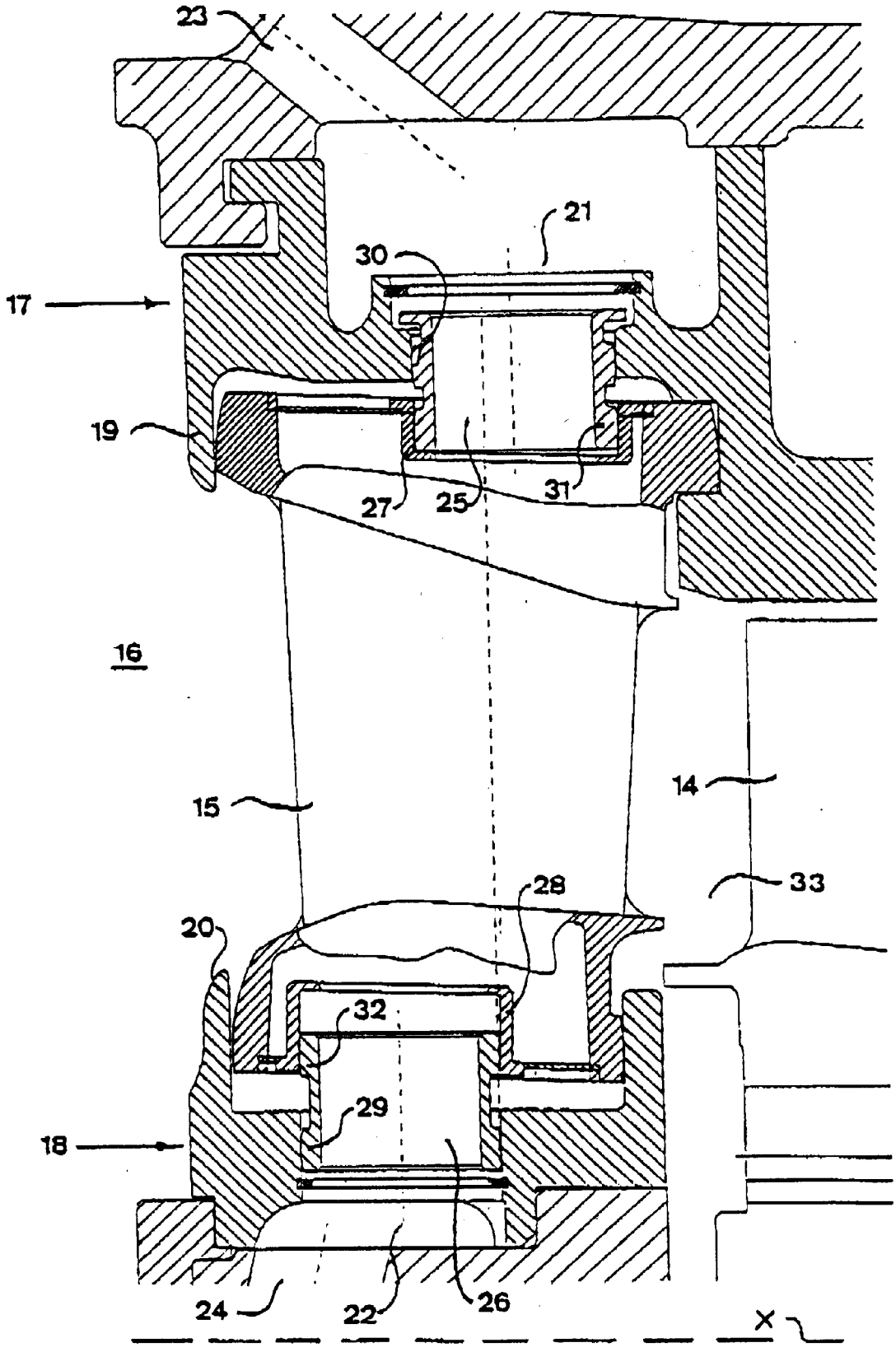
Figure 3:
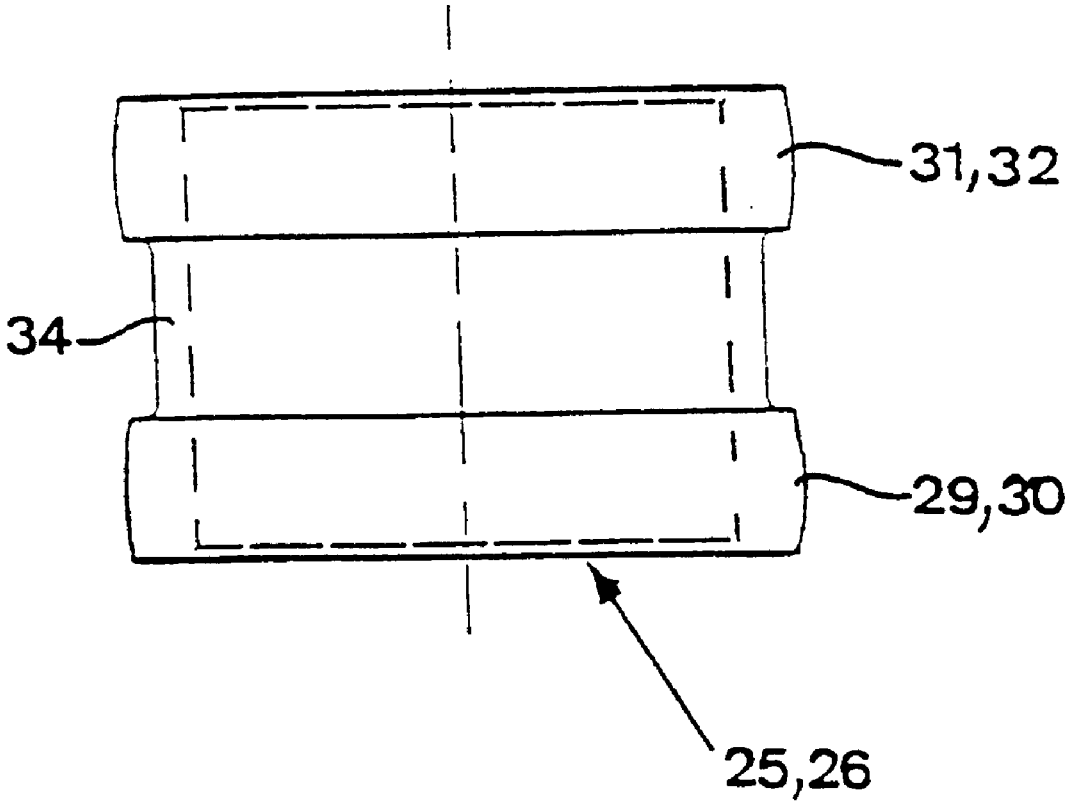

An embodiment of the rotor machine arrangement according to the invention will now be described by means of a non-limiting example and with reference to the appendant drawings, on which:

FIG. 1 is a cross-sectional view from the side, showing a rotor machine arrangement according to the invention, and FIG. 2 is a cross-sectional view from the side of a part of the rotor machine arrangement, and FIG. 3 is a sideview of a sealing element.

DETAILED DESCRIPTION OF AN EMBODIMENT

The rotor machine arrangement according to the invention defines a gas turbine arrangement 1, which is clear from FIG. 1. The gas turbine arrangement 1 comprises a compressor 2 and a turbine 3. Furthermore, it comprises a combustion chamber 4 of an annular kind. At the combustion chamber 4 a plurality of burner members 5 are arranged. These are arranged to cause combustion in the combustion chamber 4 for generating a hot gas in the same. The combustion chamber 4 is at one of its ends provided with an outlet opening via which the generated gas may flow into and run the turbine 3. The compressor 2 is primarily intended to deliver a compressor medium, in this case compressed air, to the burner members 5, which use the compressor medium/air for their combustion function.

The compressor 2, the combustion chamber 4 and the turbine 3 are co-axially arranged and connected with each other in that order.

The compressor 2 comprises a stator 6 and a rotor 7. The stator 6 comprises a plurality of guide vane rings 8 which in a known manner comprise a plurality of guide vanes.

The rotor 7 is formed by a plurality of disks 9, which preferably are welded together by means of electron beam welding. Radially outside of the rotor disks 9 rotor blades 10 are arranged on the respective rotor disk 9.

The turbine 3 comprises a stator 11 and a rotor 12. The rotor 12 may, such as here, comprise a plurality, in this case three, rotor disk 13, on which rings of rotor blades 14 are arranged in a manner known per se. The stator 11 comprises arrays of guide vanes 15, which in a manner known per se are arranged in rows. With reference to FIG. 2, an upper section of the stator is shown. The guide vanes 15 in the row which is positioned closest to the inlet opening 16 of the turbine 3, i.e. the guide vane row positioned most upstreams, are at opposite ends carried in a radially outer stator part 17 and a radially inner stator part 18. The guide vanes 15 are thereby pivotably connected to intermediate guide vane support members 19, 20, which are attached to the outer 17 and inner 18 stator part, respectively.

Between the guide vane support members 19, 20 and the respective stator parts 17, 18, ring-shaped chambers 21, 22 are arranged. The ring-shaped chambers 21, 22 form thereby part of conducting members 23, 24, via which cooling air is conducted to the guide vanes 15. Sealing elements 25, 26 which define end portions of the conducting members 23, 24 are thereby arranged to conduct the cooling air from the chambers 21, 22 to the ends of the guide vanes 15. The sealing elements 25, 26 comprise short, radial tubes which are arranged to sealingly abut the guide vane support members 19, 20 and the inner circumference of a respective sleeve 27, 28, wherein said sleeves 27, 28 are arranged in recesses in the respective ends of the guide vanes 15 and secured to the guide vanes 15. The tube formed sealing elements 25, 26 have in one of their ends a ring-shaped bulge which extends around the outer circumference of the sealing element 25, 26, which has a rounded outer contour, preferably spherical, and which is arranged to abut the inner circumference of a guide vane support member 18, 19 which is connected with and forms part of the stator 11. In its opposite end, the sealing element 25, 26 has a further bulge 31, 32 which also extends around the outer circumference of the sealing element 25, 26 and which has a rounded, preferably spherical, outer contour and which is arranged to sealingly abut the inner circumference of a recess in the guide vane end or, more precisely, a sleeve 27, 28 arranged therein. Thanks to the bulges 29–32, the sealing element 25, 26 may be tilted relative to the guide vane support member 19, 20 and the sleeve 27, 28 which it abuts with maintained sealing ability. Such a situation arises normally in connection with the temperature influence of the gases onto the respective stator parts 17, 18 of the stator 11. This temperature influence causes mutual displacement of the stator parts 17, 18 in the axial direction of the turbine 3, and consequently a tilting of the guide vanes 15 which are connected with the respective stator parts 17, 18, in planes in which the rotor axis (x) of the rotor machine arrangement, or, more precisely, of the rotor 3 extends.

The cooling medium which is used in the manner described above for cooling the guide vanes 15 is preferably air which has been drained off from the compressor 2 and via a separate, not more closely shown system for draining off is conducted to the conducting members 23, 24 and via these into the interior of the guide vanes 15. The guide vanes 15 are for this purpose formed to be hollow and have small holes arranged to conduct the cooling medium further out into the gas flow channel when it has served its purpose.

In particular, the tilting of the guide vanes 15 will take place in a plane which extends essentially in parallel with the axial direction of the turbine 3. Thanks to the fact that the contact surfaces of the sealing elements 25, 26 with the stator 11 and the guide vanes 15, respectively, in the manner described above are essentially barrel-shaped, the sealing elements 25, 26 may, however, be tilted in all directions without any increased air leakage from the ring chambers 21, 22 into the gas flow channel 33.

From FIG. 3 it is clear in more detail how the short, tube-formed sealing elements 25, 26 at their opposite ends are provided with gently rounded bulges. Consequently, the sealing elements 25, 26 have a waist 34 with a somewhat smaller outer circumference than the surrounding bulges 29–32.

It should be understood that a number of variations and alternative embodiments to the above as an example shown embodiment will be evident to the person skilled in the art without this person thereby leaving the scope of the invention, such as this is defined in the appendant claims.

With the concept "independent of the angular position" in this application is primarily referred to the angular positions which may be expected to appear between the components involved in a rotor machine arrangement of the described kind, i.e. relatively small tiltings of guide vanes and sealing elements.

With a pivotably arranged guide vane relative to the stator is primarily meant pivoting as a consequence of mutual displacement of the outer and inner stator parts 17, 18 with which the guide vane 15 is connected at its opposite ends. The pivoting of the guide vane should thus not be confused with the kind of conventional rotary movement which such a guide vane of course may present. The displacement of the stator part 17, 18 takes place because of temperature influence and preferably in the rotor axis direction x of the turbine 3, and causes thereby a tilting of the ends of the guide vane 15 relative to the guide vane support members 19, 20 in which they are pivotably, i.e. tiltably, arranged.

What is claimed:

1. A rotor machine arrangement, comprising a rotor, a stator, at least one guide vane, which at two opposite ends is supported by the stator and at both ends is pivotably arranged relative to the stator in at least a first plane, and at least one conducting member arranged to conduct a fluid into the guide vane for influencing the temperature of the same, the rotor machine arrangement comprises at least one sealing element, which is pivotably connected with the guide vane in at least said first plane and which is arranged to seal between the stator and the guide vane, wherein the sealing function of said sealing element is essentially independent of the angular position between the guide vane and the stator in said first plane, wherein the sealing element comprises a first sealing member arranged to seal between the guide vane and the sealing element, wherein the sealing function of said first sealing member is essentially independent of the angular position between the guide vane and the sealing element in said first plane, wherein the sealing element is pivotably arranged relative to the stator in said first plane, wherein the sealing element comprises a second sealing member, arranged to seal between the sealing element and the stator, wherein the sealing function of said second sealing member is essentially independent of the angular position between the sealing element and the stator in said first plane, wherein said rotor machine arrangement comprises at least two said sealing elements, wherein one such sealing element is positioned at one end of said guide vane and a second such sealing element is positioned at the opposite end of said guide vane.

2. A rotor machine arrangement according to claim 1, wherein the first sealing member comprises a bulge which extends around the outer circumference of the sealing element.

3. A rotor machine arrangement according to claim 1, wherein the second sealing member comprises a bulge which extends around the outer circumference of the sealing element.

4. A rotor machine arrangement according to claim 1, wherein the sealing element comprises a cylinder body with annular cross section and with at least one annular bulge which extends around the outer circumference of the same and defines the sealing member.

5. A rotor machine according to claim 1, wherein the sealing element comprises a cylinder body with an annular cross section and with two annular bulges, each of which extends around the outer circumference of the sealing element and defines a respective sealing member.

6. A rotor machine arrangement according to claim 1, wherein the sealing element projects into a recess at the end of the guide vane with which it is connected.

7. A rotor machine arrangement according to claim 6, wherein the first sealing element is arranged to abut the inner circumference of the recess.

8. A rotor machine arrangement according to claim 1, wherein the sealing element projects through a support member connected with the stator and arranged to support the guide vane, and in that the second sealing member is arranged to abut an inner circumference of the support member.

9. A rotor arrangement according to claim 1, wherein a further conducting member is arranged to conduct a fluid influencing the temperature to the second end of the guide vane.

10. A rotor machine arrangement according to claim 1, wherein it comprises a plurality of guide vanes, arranged in a ring and each of which is connected with said conducting member, wherein first and/or second sealing members are arranged at each of the guide vanes.

11. A rotor machine according to claim 1, wherein said first plane is one of the planes in which the rotor axis of the rotor machine arrangement extends.

* * * * *